United States Patent [19]

Pasternack

[11] 4,286,439

[45] Sep. 1, 1981

[54] SUIT FOR PROTECTING A PERSON'S BODY FROM HEAT AND GAS

[75] Inventor: Adalbert Pasternack, Bad Schwartau, Fed. Rep. of Germany

[73] Assignee: Drägerwerk Aktiengesellschaft, Lübeck, Fed. Rep. of Germany

[21] Appl. No.: 96,245

[22] Filed: Nov. 20, 1979

Related U.S. Application Data

[63] Continuation of Ser. No. 858,429, Dec. 7, 1977, abandoned.

[30] Foreign Application Priority Data

Dec. 10, 1976 [DE] Fed. Rep. of Germany ..... 2655953

[51] Int. Cl.[3] ..... F25D 23/12; F25B 49/00

[52] U.S. Cl. ..... 62/259.3; 2/2.1 R; 62/125

[58] Field of Search ..... 62/259 B, 125, 131; 2/2.1 R, 2.1 A; 128/202.22, 202.26; 73/314, 427

[56] References Cited

U.S. PATENT DOCUMENTS

| | | | |
|---|---|---|---|
| 1,847,844 | 3/1932 | McLaren | 62/131 X |
| 2,819,590 | 1/1958 | Green | 62/259 B |
| 3,161,192 | 12/1964 | McCormack | 2/2.1 R X |
| 3,496,703 | 2/1970 | MacLeod et al. | 62/259 B |
| 3,773,044 | 11/1973 | Wallace | 128/202.26 X |
| 3,869,871 | 3/1975 | Rybalko | 62/259 B |
| 4,024,730 | 5/1977 | Bell et al. | 62/259 B |
| 4,095,593 | 6/1978 | Webbon et al. | 62/259 B |

*Primary Examiner*—Lloyd L. King

*Attorney, Agent, or Firm*—McGlew and Tuttle

[57] ABSTRACT

A protective device for protecting a person's body from heat and gas, comprises a body suit which covers the person's body and which has a refrigerant storage tank connected to the back of the suit for storing a solid refrigerant, such as dry ice. The refrigerant, or a liquid produced from the refrigerant, is circulated from the tank around the suit for cooling the suit and the wearer. The apparatus includes an indicator having a display portion located in the field of vision of the wearer and connected back to the tank for indicating the condition of the refrigerant, such as, the total amount of solid refrigerant left, whether the melted refrigerant is leaking from the system and/or any other condition concerning the cooling system to the wearer.

3 Claims, 6 Drawing Figures

SUIT FOR PROTECTING A PERSON'S BODY FROM HEAT AND GAS

This is a continuation of application Ser. No. 858,429, filed Dec. 7, 1977, now abandoned.

FIELD AND BACKGROUND OF THE INVENTION

This invention relates to personnel protective devices in general and, in particular, to a new and useful heat and gas protection suit with monitoring of the function of a cooling system using a solid refrigerant with pump-driven circulation of the liquid coolant.

DESCRIPTION OF THE PRIOR ART

The heat developed by the human body is normally dissipated directly to the ambient atmosphere by radiation and convention. In addition, indirect heat dissipation due to the evaporation of perspiration may also take place if the temperature of the surroundings is higher than the skin temperature. However, heat dissipation through evaporation is limited by the receptivity of the surroundings when it is higher in temperature than the skin temperature. Heat dissipation through evaporation is also limited by the receptivity of the surroundings, i.e., when the ambient vapor pressure exceeds the value attainable on a completely moist skin at the permissible upper skin temperature limit. Due to the protective suit enveloping the body, this limit is soon reached due to the body heat and the possibly high outside temperature. Therefore, suits to be used for such purposes have devices for the dissipation of heat, but in order to preserve the suit wearer's health and his ability to work, a functioning cooling system is a prerequisite.

A ventilated pressure suit with devices for cooling and heating the skin is known. For this purpose, a system of thin, flexible tubes through which cooling water is circulated is worked into the suit. In addition, a special embodiment includes a tank with ice as a cooler and a circulating pump for the circulation of the cooling medium. The coolant temperature is controllable by means of a bypass located ahead of the cooler which is controlled by a three-way valve and is included in the circulation system. For this purpose, the three-way valve may be a thermostat-controlled valve. The refrigerant tank may comprise a transparent material. A disadvantage of this prior arrangement is that the pressure suit contains no means for controlling any possible leakage of the liquid circulation and the ice supply cannot be watched by the suit wearer himself. (German Pat. No. 3,991,929.)

A portable life support system with air conditioning with which the protective suit is equipped is also known. This protective suit has an inner air chamber which is supplied with breathable air and a liquid chamber for air conditioning is disposed outwardly above it. A circulatory system supplies the inner air chamber with breathable air and, at the same time, it maintains a certain internal pressure. Circulated by a pump, the amount of breathable air is moved in circulation and kept breathable by the removal of carbon dioxide and odors and by the introduction of oxygen. However, the liquid chamber is filled with a coolant circulated by the same pump through separate lines. After having cooled the breathable air by the heat exchange during the circulation, and also having absorbed the excess body heat while flowing through the liquid chamber of the suit, the coolant is cooled again and again in an evaporator. The evaporator is resupplied with refrigerant from a supply through a wick connection.

Both the breathing air and the liquid circulation which are separated from each other by a movable diaphragm flow through a liquid supply tank. The pressure in the breathing air circulation is controlled by the diaphragm so that there is constant refilling of the liquid circulation in the event of liquid losses. There is no indication of the filling level in the supply tank and thus no indication of the magnitude of possible leakage. The suit wearer is not warned prior to reduced cooling. The coolant supply remains unwatched, for which reason, the suit wearer cannot determine when the cooling system will fail due to the lack of the coolant. (See U.S. Pat. No. 3,500,827).

SUMMARY OF THE INVENTION

The present invention provides a heat and gas protection suit which is safe in regard to cooling. The suit wearer is able to observe the function of the cooling system with respect to the coolant supply, as well as to tightness, or only one of the two.

According to the invention, this problem is solved by an indicator, readable within the suit wearer's field of vision, for the refrigerant supply and/or the tightness of the cooling system.

The particular advantages obtained by the invention are that the two conditions required for the life support function of the cooling system can be observed constantly by the suit wearer, eigher simultaneously, or, for special reasons, only singly. The display is directly in the field of vision of the wearer of the suit and it is fed by simple and operationally safe connections. According to the invention, several embodiments of the refrigerant supply display and also for the liquid indicator are possible.

The refrigerant supply indicator consists of a pressure plate on the refrigerant which moves to effect transmission of the filling level on the indicator. This design represents a simple and reliable solution. The pressure plate on the solid refrigerant determines unequivocally the refrigerant level remaining in its tank. Due to the transmission of this level to the suit wearer's field of vision, he can determine the refrigerant supply at any time and guide his further actions accordingly.

The transmission comprises a drawstring connecting the pressure plate to a windup spool loaded against the direction of rotation by a torsion spring, and provided with a scale. The transmission may also comprise a bellows pressing against the pressure plate, the interior of the bellows being connected to an underpressure manometer via a tube. Alternatively, the transmission is an electric circuit which is activated by contacts between the pressure plate and the refrigerant tank and contains a signal lamp. All of these designs assure unequivocal and reliable indication of the refrigerant supply to the wearer.

The leakage indicator monitors the coolant amount circulated by a pump. To do this, the cooling system must be tight even when pressurized. The leakage indicator comprises either a communicating measuring tube connected to the pump suction nipple via a tube, or it consists of a bellows disposed in an intermediate tank inserted in the pressurized coolant circulation and connected to a manometer via a tube. Both embodiments are simple in their design and permit easy monitoring of the tightness of the cooling system. The particular advantage of the last-described embodiment is its operating mode which is completely independent of location.

Accordingly, it is an object of the invention to provide a body suit for protecting a wearer against heat and gases, which includes a tank mounted in the suit or on the suit, which includes a refrigerant, and which includes means for circulating the refrigerant throughout the body suit and means for indicating the condition of the refrigerant in the tank displayed in the field of vision of the wearer so that he can be assured of obtaining adequate information concerning the cooling which may be expected from the suit.

Another object of the invention is to provide a device for indicating the condition of a refrigerant in a tank carried in a protective suit into the field of vision of a wearer, for example, in the visor area of a helmet of the suit.

A further object of the invention is to provide a protective suit having means for indicating a cooling system condition, which is simple in design, rugged in construction and econommical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and discriptive matter in which preferred embodiments of the invention are illustrated.

DESCRIPTION OF THE PREFERRED EMBODIMENTS

Figure 1:
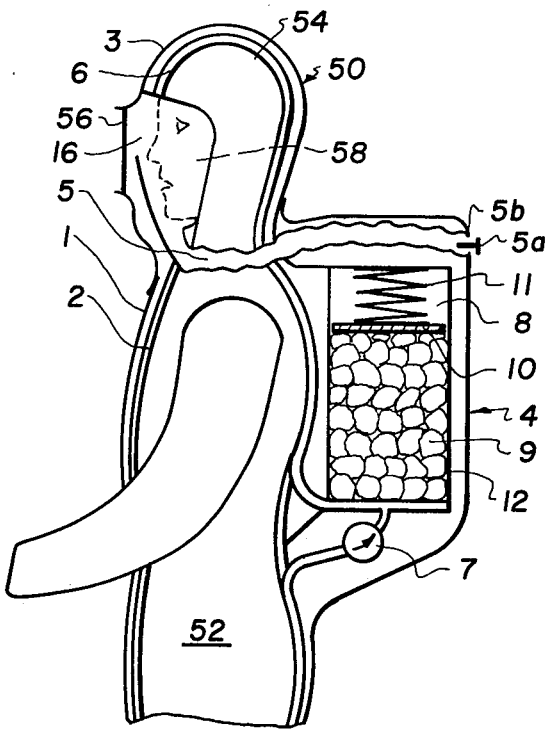
FIG. 1 is a schematic side elevational and sectional view of a heat protection suit constructed in accordance with the invention.

Referring to the drawings in particular, the invention embodied therein, comprises a body suit, generally designated 50, for protecting a wearer from high temperature conditions and from noxious gases. The suit 50 is of double-walled construction and it includes a helmet portion 54 having a glass or other transparent visor portion 56, which is positioned in front of a wearer's face 58. In the embodiments of the invention which are shown, the suit advantageously includes both a breathing system, including a breathing tube having a control valve 5*a* and an inlet opening 5*b* and a cooling system, generally designated 4, which includes a back-mounted refrigerant tank for a solid refrigerant, such as ice or carbon dioxide.

In accordance with the invention, the solid coolant or refrigerant 9 is disposed in a tank 12 and the melting produces a liquid which is circulated in cooling system 4 by a circulating pump 7. In the embodiment illustrated, the solid refrigerant 9 is carried in a tank 12 which is positioned on the back of the wearer, but the tank may be carried in another location, for example, on the chest of the wearer, if so desired.

The heat and gas protection suit 50 comprises an outer suit portion 1 and an inner suit portion 2, a helmet 3 and a cooling system 4. The outer suit 1 protects the suit wearer from excessive, direct, external heat, while the inner suit 2 is double-walled or provided with channels 6, through which the liquid coolant is circulated by pump 7. The solid refrigerant 9 is located in a heat exchanger portion 8 of the refrigerant tank 12 and through its sublimation, the heat returned to the tank by the liquid coolant is dissipated.

Figure 2:
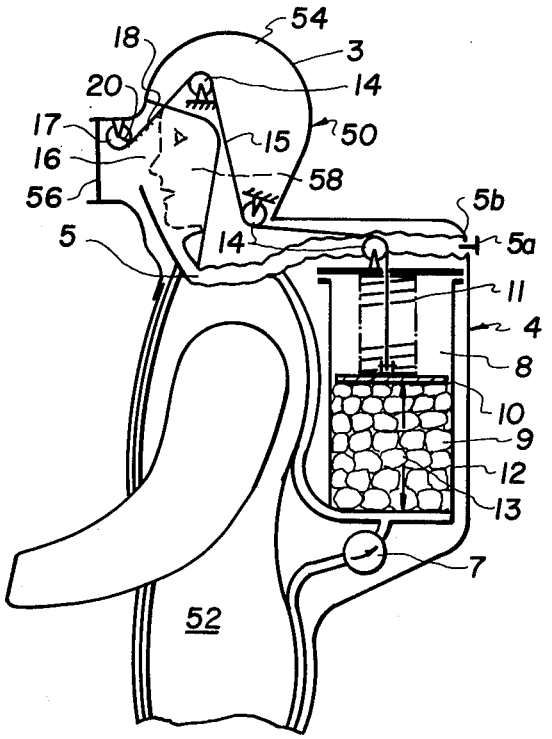
FIG. 2 is a view similar to FIG. 1 of another embodiment of the invention.
Figure 3:
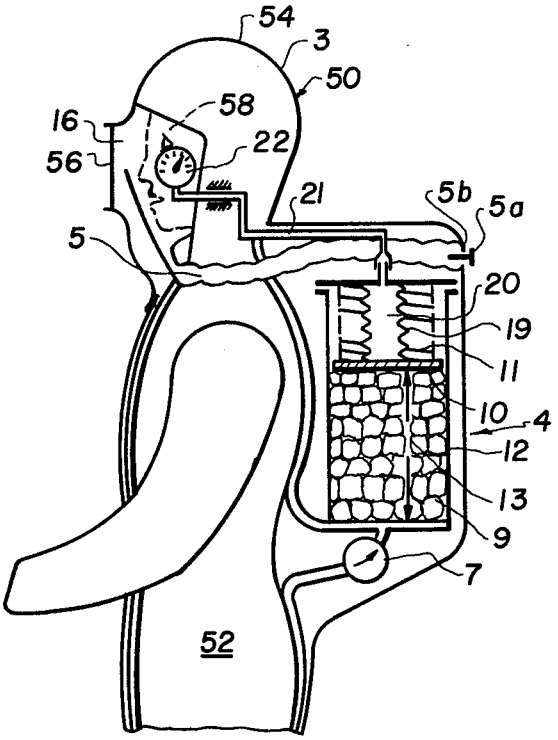
FIGS. 3 through 6 are views similar to FIG. 2 of still further embodiments of the invention.
Figure 4:
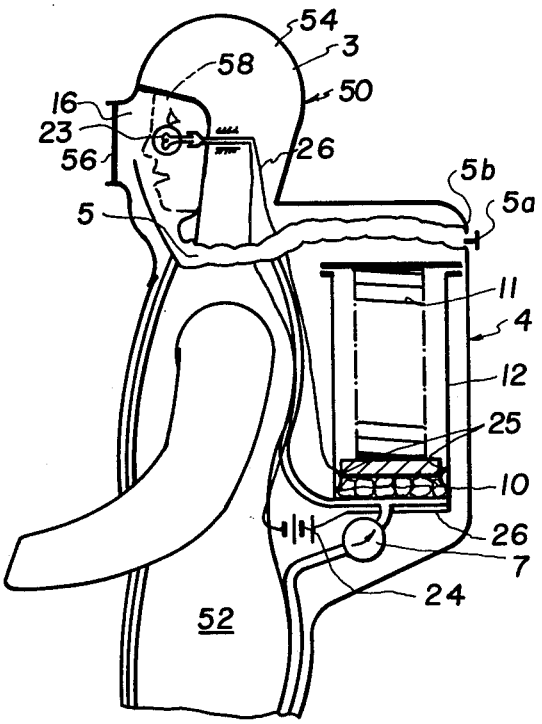

FIGS. 2, 3 and 4 show refrigerant supply indicators. The pressure plate 10, pushed against the refrigerant 9 in the refrigerant tank 12 by the compression spring 11 is common to all of the embodiments of FIGS. 2, 3 and 4. The refrigerant supply is determined from the momentary filling level 13 and the known cross-sectional area of the refrigerant tank 12.

In the embodiment according to FIG. 1, pressure plate 10 is connected via a drawstring 15 led across rollers 14 to the windup spool 17 located in the field of vision 16. A torsion spring 20 at the windup spool 17 keeps the drawstring 15 tight at all times. The drawstring 15 has a scale 18 within the field of vision 16, the graduations of which are a measure of the filling level 13 and, hence, of the refrigerant supply.

In the embodiment according to FIG. 3, the bellows 19 pressing on the pressure plate 10 is disposed inside of the compression spring 11. Its interior 20 communicates via the line 21 with the underpressure manometer 22 disposed in the field of vision 16. Any change in the filling level 13 leads to a readable pressure change in the underpressure manometer 22. The pressure change is a measure of the refrigerant supply.

Figure 5:
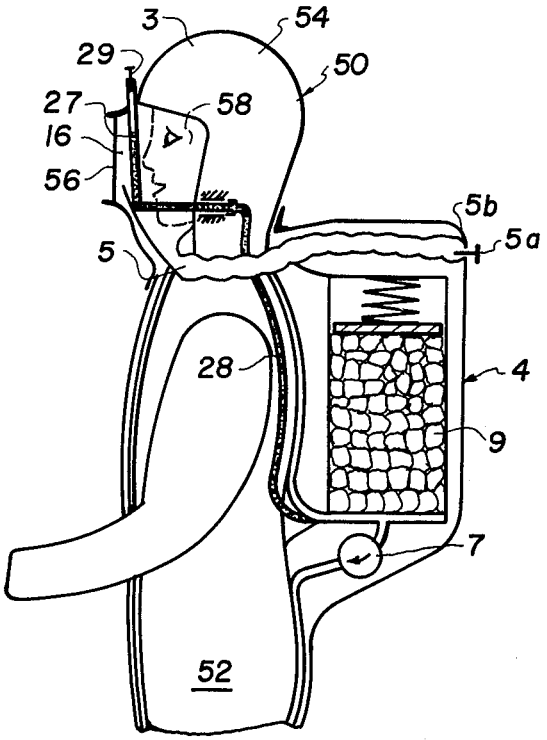
Figure 6:
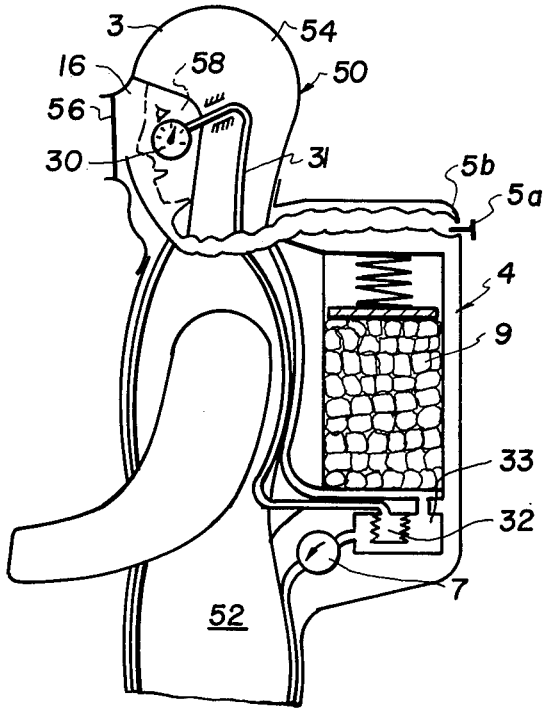

The embodiment according to FIG. 4 contains an electric circuit 26 which incidates through the lighting of the signal lamp 23 disposed in the field of vision 16 that a selected refrigerant reserve supply has been reached. The circuit 26, fed by the battery 24, is activated by contacts 25 between the pressure plate 10 and the refrigerant tank 12. FIGS. 5 and 6 show leakage indicators which may be employed alone or in the protective suits of FIGS. 1 through 4.

The embodiment of FIG. 5 has a measuring tube 27 directly communicating with the liquid coolant. It is disposed in the field of vision 16. The connector of the connecting line 28 to the coolant is located ahead of the suction nipple of pump 7. The measuring tube 27 has an adjusting screw 29 by means of which the coolant level can be regulated to be readable in its measuring range. Dropping of the coolant level is a measure of leakages in the cooling system.

In the embodiment according to FIG. 6 the coolant is pressurized. The leakage indicator is the manometer 30 which communicates via line 31 with the interior of the bellows 32. Bellows 32 is disposed in the intermediate tank 33 inserted in the coolant circulation. Pressure changes in the cooling system, indicated by the manometer, are an indication and a measure of leakages. As in the embodiment according to FIG. 5, they are associated with a coolant loss.

While specific embodiments of the invention have been shown and described in detail to illustrate the application of the principles of the invention, it will be understood that the invention may be embodied otherwise without departing from such principles.

What is claimed is:

1. A protective device for protecting a person's body from heat and gas, comprising a body suit covering the body, having a head portion with a viewing visor in the wearer's field of vision with a refrigeratant storage tank having a consumable refrigerant therein connected to said suit, a refrigerant conduit distributed over said suit, means for circulating refrigerant from said tank through said refrigerant conduit for cooling the body suit and the person's body, and indicator means including a connecting line connected to said tank and having a visual indicator which extends into the field of vision of the wearer and a device for continuously monitoring the amount of refrigerant present including a member in said tank bearing against the refrigerant and movable in response to changes in amount of the refrigerant so that this amount is shown in said visual indicator so as to indicate the state of refrigerant in said storage tank connected to said connecting line.

2. A protection device according to claim 1, wherein said refrigerant comprises dry ice and including a plate overlying the dry ice, means for biasing the plate against the dry ice so that it moves downwardly upon the dry ice being consumed, said refrigerant also including a liquid cooled by the dry ice and circulated through said body suit.

3. A protection device for protecting a person's body from heat and gas, comprising a body suit covering the body, having a head portion with a viewing visor in the wearer's field of vision with a refrigerant storage tank connected to said suit, a refrigerant conduit distributed over said suit, means for circulating refrigerant from said tank through said refrigerant conduit for cooling, and indicator means including a connecting line connected to said tank and having a visual indicator which extends into the field of vision of the wearer, and indicator means for indicating the state of the refrigerant in said storage tank connected to said connecting line, said indicator means including a separate tank connected between said tank and said circulating means, a bellows in said separate tank connected to said connection line and being compressible by variations in the contents of said separate tank to indicate the presence of a refrigerant in the circulating line.

* * * * *